US006341666B1

(12) United States Patent
Allen

(10) Patent No.: US 6,341,666 B1
(45) Date of Patent: Jan. 29, 2002

(54) STEPLADDER ACCESSORY TRAY

(76) Inventor: Barry W. Allen, 413 S. Meadow La., Mustang, OK (US) 73064

( * ) Notice: Subject to any disclaimer, the term of this patent is extended or adjusted under 35 U.S.C. 154(b) by 0 days.

(21) Appl. No.: 09/548,510

(22) Filed: Apr. 13, 2000

Related U.S. Application Data

(63) Continuation-in-part of application No. 09/164,031, filed on Sep. 30, 1998, now abandoned.

(51) Int. Cl.[7] ..... E04G 1/00; A47G 29/02
(52) U.S. Cl. ..... 182/129; 248/238
(58) Field of Search ..... 182/129, 120, 182/121, 122, 214, 107; 248/210, 238

(56) References Cited

U.S. PATENT DOCUMENTS

| | | | | | |
|---|---|---|---|---|---|
| 2,473,951 | A | * | 6/1949 | Hickey | 182/120 |
| 2,694,825 | A | | 11/1954 | Touchett | |
| 2,865,546 | A | * | 12/1958 | Shull | 182/129 X |
| D205,443 | S | | 8/1966 | Layman | |
| 4,016,955 | A | | 4/1977 | Gates | |
| 4,261,435 | A | | 4/1981 | Winter | |
| 4,589,521 | A | | 5/1986 | Finster et al. | |
| 4,624,430 | A | | 11/1986 | Ehmke | |
| 4,653,713 | A | | 3/1987 | Hamilton | |
| 4,730,802 | A | | 3/1988 | Chatham et al. | |
| 4,874,147 | A | | 10/1989 | Ory et al. | |
| 4,949,925 | A | * | 8/1990 | Gorecki | 182/129 X |
| 5,052,581 | A | * | 10/1991 | Christ et al. | 182/121 X |
| 5,058,707 | A | * | 10/1991 | Waid | 182/120 |
| 5,079,795 | A | | 1/1992 | Schmid | |
| 5,098,052 | A | * | 3/1992 | Beck | 248/238 |
| 5,191,954 | A | | 3/1993 | Ledford | |
| 5,342,008 | A | * | 8/1994 | Kay | 248/238 |
| 5,421,428 | A | | 6/1995 | Ingles | |
| 5,503,245 | A | | 4/1996 | Etesam | |
| 5,507,363 | A | | 4/1996 | Tredup | |
| 5,641,142 | A | | 6/1997 | Hanson et al. | |
| 5,673,885 | A | * | 10/1997 | Pham | 248/210 |
| 5,782,314 | A | | 7/1998 | Zeitler | |
| D397,833 | S | | 9/1998 | Adams Zurawin | |
| 5,836,557 | A | * | 11/1998 | Bailey et al. | 248/210 |
| 5,899,296 | A | | 5/1999 | Lantz | |
| 5,901,998 | A | * | 5/1999 | Gallo, Jr. | 182/129 X |
| 6,000,497 | A | * | 12/1999 | Kain et al. | 182/129 |

* cited by examiner

*Primary Examiner*—Daniel P. Stodola
*Assistant Examiner*—Hugh B. Thompson
(74) *Attorney, Agent, or Firm*—James F. Harvey, II

(57) ABSTRACT

An accessory tray for a stepladder comprises a generally rectangular panel having portions configured to extend about the front and sides of a stepladder. An upstanding lip is attached to the periphery edges of the tray, the lip having notches formed therein particularly adapted to secure the mounting clips and pan of a roller-type paint tray to the accessory tray. A clamping assembly is rigidly attached to the underside of the panel for mounting the tray to the fold-out shelf of a stepladder. The clamping assembly includes a clip member that presents a channel into which the fold-out shelf or other thin planar surface of the stepladder is secured. The position of the tray is maintained by a fastener which extends through the clip member into a friction fit relationship with the shelf.

19 Claims, 4 Drawing Sheets

STEPLADDER ACCESSORY TRAY

CROSS-REFERENCES TO RELATED APPLICATIONS

This application is a Continuation-In-Part of inventor's prior U.S. patent application Ser. No. 09/164,031, filed on Sep. 30, 1998, now abandoned

BACKGROUND OF THE INVENTION

This invention relates generally to ladder trays and, more particularly, to an accessory tray which can be attached to the fold-out shelf of a stepladder for holding paint cans, paint trays, tools, and the like.

Painters, carpenters, and other tradesmen often utilize stepladders to accomplish their work. The problem of safely holding and using many tools and accessories while standing on the ladder is frequently experienced by such workers. Accordingly, workers must either make frequent trips up and down the ladder to obtain necessary items or attempt to carry everything up the ladder at the same time.

Various trays have been proposed in their prior art which can attach to or rest upon stepladders. Although assumably effective for their intended purposes, some such devices are not particularly adapted to be securely mounted to the fold-out shelf of the stepladder. Other devices are relatively complex in construction or in the mode of attachment to a stepladder. Further, prior devices adapted for attachment to the shelf of a stepladder effectively preclude the use of a roller paint tray. Finally, prior devices generally will not remain level when removed from the stepladder and placed on a level surface, due to the presence of various mechanisms employed to attach the tray to the stepladder. This makes it difficult to maintain levels of paint or other liquids which may have been placed on the accessory tray either in preparation for ascending the stepladder or upon descent from the stepladder.

It is therefore desirable to have a stepladder accessory tray for holding tools and materials which can be quickly and conveniently mounted to or removed from the shelf of a stepladder. It is also desirable to have a stepladder tray which is adapted to hold a conventional roller paint tray. It is further desirable to have a stepladder accessory tray which will remain level on a broad surface so that it can be loaded in preparation to ascending the ladder with the tray in hand.

SUMMARY OF THE INVENTION

In response thereto, I have invented a stepladder accessory tray which comprises a panel configured to extend about the front and sides of a stepladder when attached thereto, thus enhancing the storage capacity and convenience of the tray. The tray further includes an upstanding lip extending about the peripheral edges which prevents tools and materials from sliding off the tray. The lip presents notches particularly adapted to secure the clips and pan of a roller-type paint tray to the accessory tray. A clamping assembly is integrally attached to the underside of the panel for mounting the tray to the fold-out shelf of a stepladder. A plurality of legs is also provided to maintain the surface of the tray in a horizontal position whenever it is removed from the stepladder and placed on a level surface. The legs extend a distance sufficient to prevent the clamping assembly from touching the level surface and causing the tray to rock.

The clamping assembly comprises a first arm normal to the bottom side of the panel and a second arm attached to the free end thereof and rearwardly extending parallel to the panel. Accordingly, the tray is mounted to a stepladder by slidably engaging the space between the second arm and panel with the fold-out shelf or other thin planar surface of the stepladder. The position of the tray is then secured with a fastener screwably extending through the second arm into a friction fit relationship with the shelf.

It is therefore a general object of this invention to provide a stepladder accessory tray which mounts to the fold-out shelf of a stepladder for holding tools, materials, and accessories at an elevated height.

Another object of this invention is to provide a stepladder accessory tray, as aforesaid, which can also be mounted to the top step of the stepladder.

Still another object of this invention is to provide a stepladder accessory tray, as aforesaid, which provides storage and support surfaces about the front and sides of the ladder.

Yet another object of this invention is to provide a stepladder accessory tray, as aforesaid, which is adapted to prevent tools or materials from rolling or sliding off of the tray.

Yet another object of this invention is to provide an accessory tray, as aforesaid, which can securely support a roller paint tray thereon.

A further object of the invention is to provide a stepladder accessory tray having a large surface area relative to the stepladder's fold-out shelf.

A further object of this invention is to provide an accessory tray, as aforesaid, which can be quickly and easily mounted to a stepladder.

A further object of this invention is to provide an accessory tray which will maintain a horizontal and stable orientation whenever it is removed from the stepladder and placed on a level surface.

Other objects and advantages of this invention will become apparent from the following description taken in connection with the accompanying drawings, wherein is set forth by way of illustration and example, an embodiment of this invention.

DETAILED DESCRIPTION OF THE PREFERRED EMBODIMENT

Figure 1:
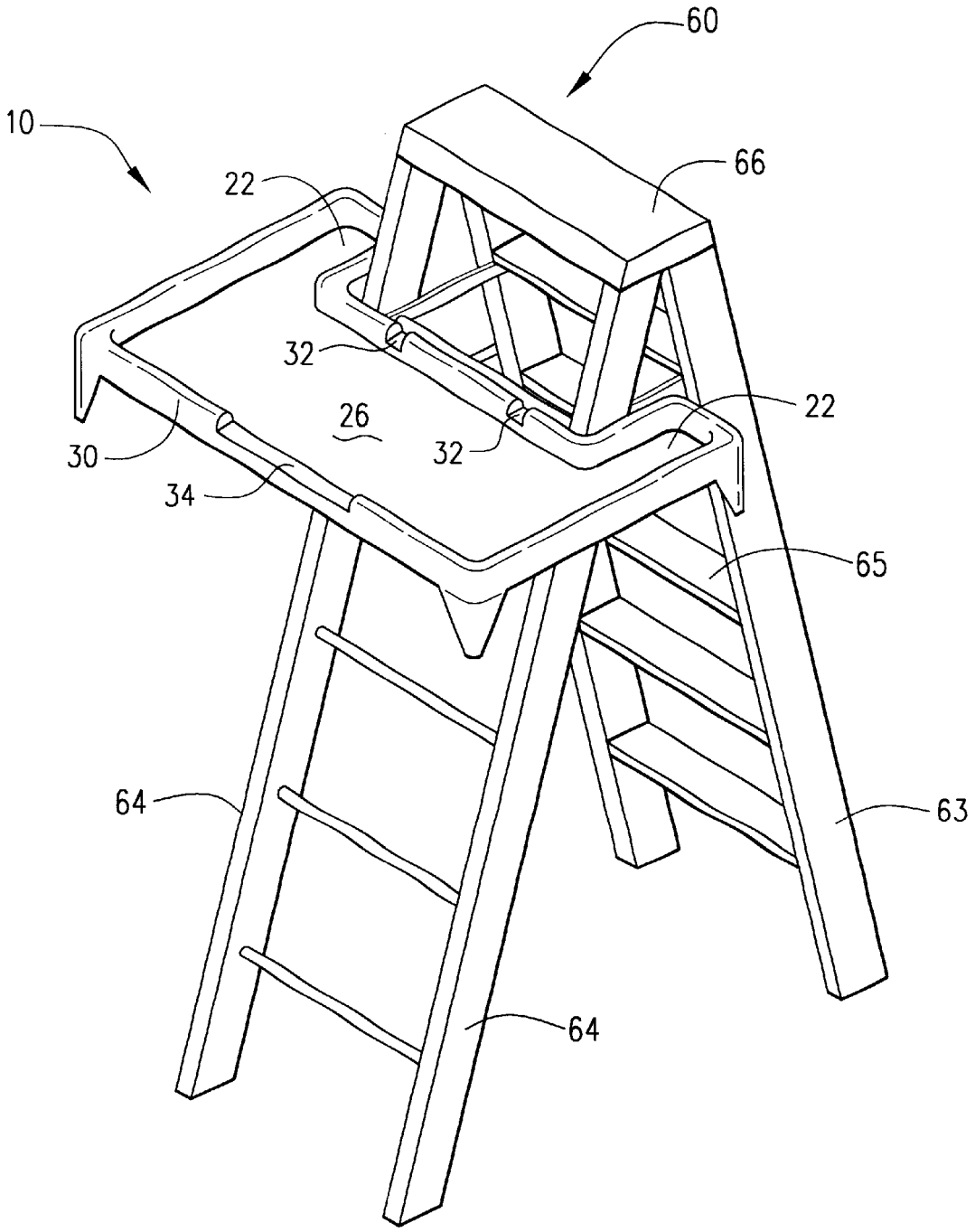
FIG. 1 is a perspective view of the stepladder accessory tray attached to a stepladder.
Figure 7:
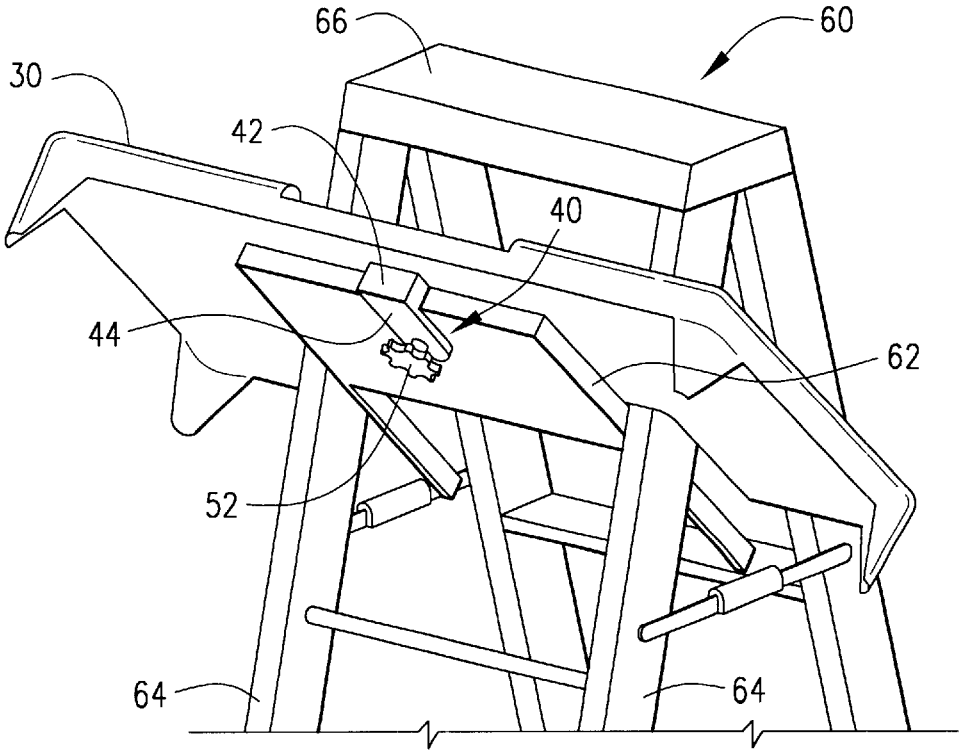
FIG. 7 is a perspective view of the accessory tray of FIG. 1 in a raised position and showing only a portion of the stepladder.

Turning more particularly to the drawings, FIGS. 1 and 7 show the accessory tray 10 secured to the fold-out shelf 62 of a conventional stepladder 60. Stepladder 60 is generally comprised of a pair of rear legs 63 between which a regularly spaced plurality of treads 65 is fixedly attached.

Rear legs 63 terminate at the lower surface of the top step 66. A pair of front legs 64 also terminate at the lower surface of the top step 66. A fold-out tray is pivotally connected to the inside of each front leg 64 so that it folds from a position between front legs 64 out to a horizontal position when in use. The pair of front legs 64, the pair of rear legs 63, or both, are pivotally connected to the lower surface of top step 66 so that the legs may be folded together for ease in carrying and storage.

Figure 2:
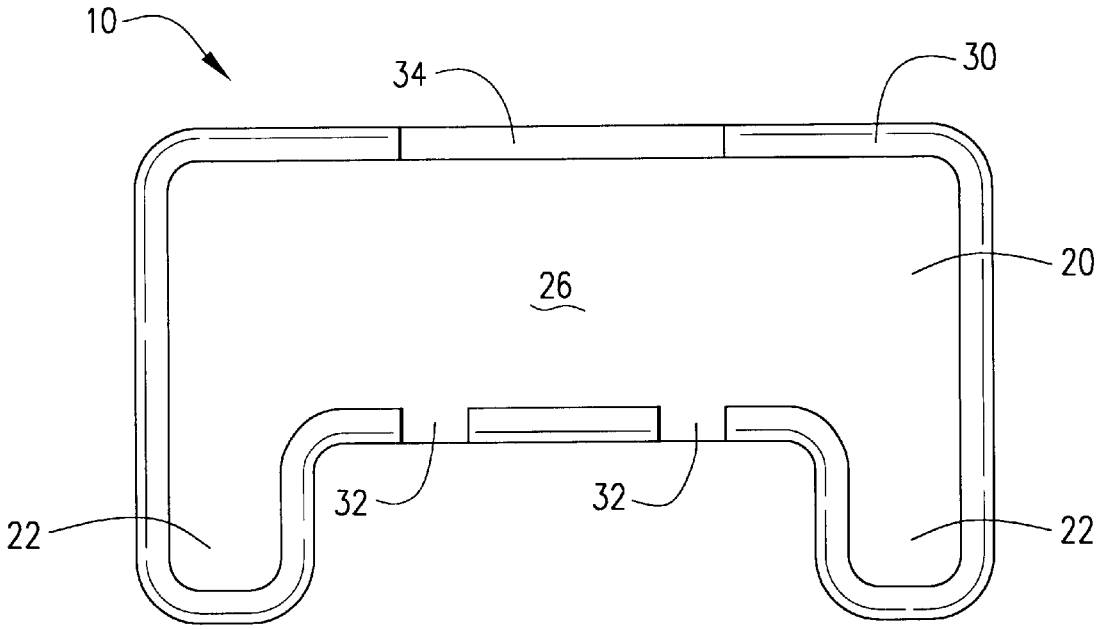
FIG. 2 is an enlarged top view of the accessory tray of FIG. 1 removed from the stepladder.
Figure 3:
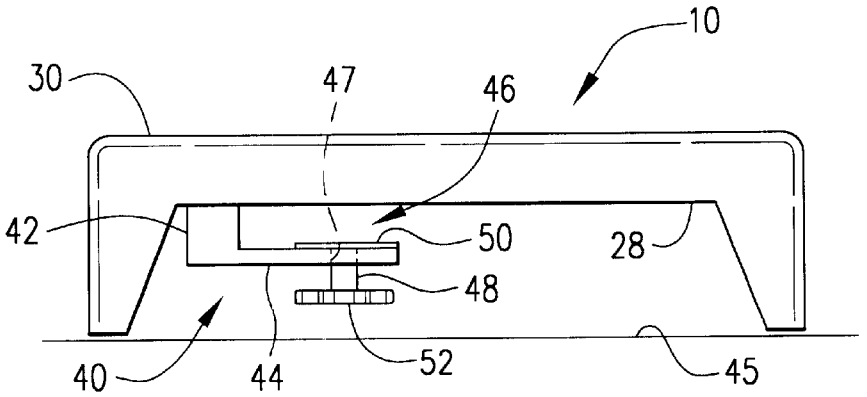
FIG. 3 is a left side view of the accessory tray of FIG. 2.

The accessory tray 10 comprises a panel 20 having a large surface area relative the fold-out shelf 62. At each corner of panel 20 extend legs 25. The tray 10 is preferably molded from a rigid plastic material although a metal construction is possible. As best seen in FIGS. 1 and 2, the panel 20 is generally rectangular and presents a recess 21 between opposed wrap-around side portions 22. The recess 21 has a width which exceeds the distance between the outer sides of legs 64 of stepladder 60 so that legs 64 can be received by panel 20. A generally rounded upwardly extending lip or flange 30 is integrally attached about the periphery of the top surface 26 of the tray 10 so as to prevent tools and work materials from sliding off of the tray 10. The lip 30 spanning the rear edge of the panel 20 has a pair of spaced apart notches 32 formed therein, adapted to slidably receive the mounting clips of a conventional roller paint tray (not shown) thereabout. Similarly, an elongated notch 34 is formed in the lip 30 spanning the front edge of the panel 20, the notch 34 being suitable for receiving the pan of a roller paint tray therein. Notch 34 is formed directly across from and in alignment with notches 32 and has a length substantially equal to the distance between the outer edges of the notches 32, as best seen in FIG. 2. The notches 32, 34 are adapted to securely hold the roller paint tray in place and present lateral movement thereof.

As shown in FIGS. 3–7, a clamping assembly 40 is fixedly and securely attached to the bottom surface 28 of the tray panel 20 for mounting tray 10 to the fold-out shelf 62 of a stepladder 60 (FIG. 7). Clamping assembly 40 comprises an arm 42 that extends downwardly from the tray's bottom surface 28 substantially adjacent the front edge of the panel 20. A second arm 44 extends rearwardly from the free end of the first arm 42 parallel to the panel 20. Accordingly, arms 42 and 44 form an L-shape clamp or clip which presents a channel 46 between the second arm 44 thereof and bottom side of the panel 20. The second arm 44 has threaded bore 47 therethrough adjacent the arm's free end. A fastener 48 screwably extends through the bore 47 of the second arm 44 with a washer 50 attached to an end of the fastener 48. It is understood that the fastener 48 can be a bolt, pin, screw, or the like. A knob 52 is integrally attached to the fastener 48 at the end thereof opposite the washer 50 for allowing a user to regulate the fastener displacement between the second arm 44 and the shelf 62. Tray legs 25 facilitate placement of panel 20 onto an arbitrary horizontal surface 45 removed from stepladder 60 so that tray 10 serves as a stable platform when the user wishes to load tray 10 with tools, paint cans, roller painting trays, and the like, in preparation for mounting and attaching tray 10 to the fold-out shelf 62. Horizontal surface 45 is envisioned to be such structure as the ground, a floor of a house, a drive way, a table, or any suitable surface which is larger in extent than the tray and which may be found at the work site. Tray legs 25 extend a distance sufficient to prevent clamping assembly 40 from coming in contact with the arbitrary horizontal surface 45.

Figure 4:
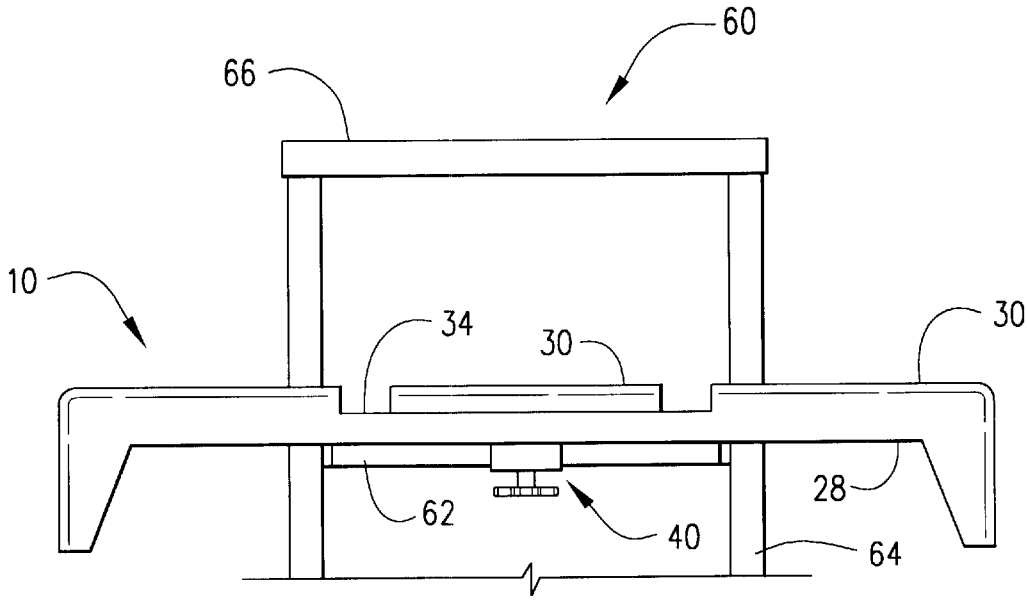
FIG. 4 is a front view of the accessory tray of FIG. 1 showing a portion of the stepladder.
Figure 5:
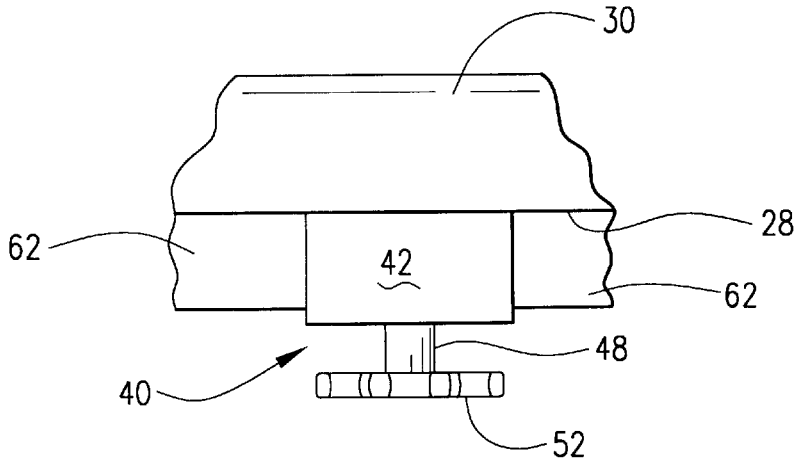
FIG. 5 is an enlarged front detail view of the tray's clamping assembly.
Figure 6:
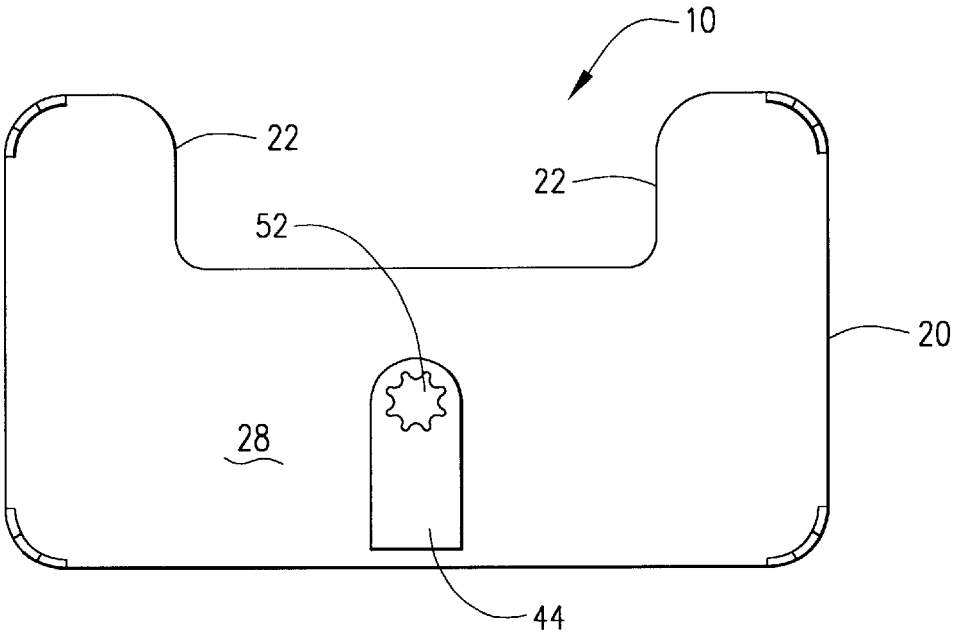
FIG. 6 is a bottom view of the accessory tray of FIG. 2.

In mounting the accessory tray 10 to a stepladder 60, the clamping assembly 40 is slidably positioned such that the conventional fold-out platform or shelf 62 is inserted into the channel 46 and sandwiched between the second arm 44 and bottom side 28 of panel 20 (FIGS. 4–6). The knob 52 is rotated to move the washer 50 into frictional engagement with the lower surface of the shelf 62. Thus, the fastener 48 and the washer 50 secure and maintain the shelf 62 within the channel 46 of the clamping assembly 40. It is also understood that the tray 10 can be mounted in like manner to any thin planar surface of the stepladder, such as the top step 66 (FIG. 1). Accordingly, the stepladder accessory tray can be easily mounted to the fold-out shelf or other planar surfaces of a stepladder for holding materials, tools, or accessories, such as a roller paint tray.

Once the panel 20 is secured in position as shown in FIGS. 1 and 7, the recess 21 extends adjacent to and across the width of the stepladder 60, with the wrap-around portions 22 extending adjacent the sides of the stepladder 60. Thus, a worker has an easily accessible storage tray along the front and sides of the stepladder 60. Also, given the location of the notches 32 and 34, any roller paint tray mounted to the panel 20 will be transverse to the stepladder 60 for easy access thereto.

It is also noted tha the tray, as above described, may be adapted to be secured to the top platform/step 66 of the ladder or to one of the steps of the ladder upon extension of the clamping assembly 40 beyond the tray 10.

While only a preferred embodiment has been illustrated and described, obvious modifications may be made within the scope of this invention and the following claims without substantially changing its functions. Accordingly, the scope of the invention should be determined not by the embodiments illustrated but by the appended claims and their legal equivalents.

The invention claimed is:

1. In combination with a conventional stepladder having sides, a back portion with steps, and a front portion with a fold-out shelf, a detachable accessory tray comprising:

a. a substantially rectangular panel member having a bottom surface and a top surface, said panel member being secured to and supported by the fold-out shelf when the fold-out shelf is horizontally positioned;

b. a recess in said panel member adapted to receive the stepladder therein with the panel member extending around the front and sides of the stepladder coplanar with the top surface;

c. a lip extending upwardly from the periphery of the top surface, the lip having a first notch therein at a first side of the panel member and a pair of spaced apart notches therein at a second side of the panel member opposite the first side, the pair of notches aligned with the first notch and spaced apart a distance substantially equal to a length of the first notch, the notches being adapted to receive and secure a roller paint tray to the panel member; and, d. a clamping assembly for attachment of the panel member to the fold-out shelf, the clamping assembly comprising:

(1) a first arm positioned normal to the bottom of the panel and having a first and second end, the first end being rigidly attached to the bottom surface;

(2) a second arm parallel to the bottom of the panel and also having a first end and a second one, the first end of the second arm rigidly connected to the second end of the first arm thus forming a channel between the bottom surface and the second arm; and, (3) a locking means associated with the second end of the second arm for secure frictional capture of the fold-out shelf within the channel and against the bottom surface.

2. The detachable accessory tray as claimed in claim 1, further comprising a plurality of panel legs extending a distance from the bottom surface of the panel member and exceeding the distance below the bottom surface that the clamp extends, whereby the horizontal orientation of the panel member can be maintained when the panel member is removed from the pivotal shelf and placed on a horizontal surface.

3. A tray for detachable attachment to a fold-out shelf of a stepladder having a front, two sides, and a fold-out shelf, the tray comprising:

a. a panel member having a rectangular portion, a bottom surface, and a top surface, the panel member adapted to be secured to and supported by the fold-out shelf when the fold-out shelf is horizontally positioned;

b. a lip extending upwardly from a periphery of the top surface, the lip having a first notch therein and a pair of spaced apart notches therein opposite the first notch, the pair of notches linearly aligned with the first notch and spaced apart a distance substantially equal to a length of the first notch, whereby the first notch and the pair of notches are adapted to receive and secure a roller paint tray removably inserted therein; and, c. a clamping assembly for attachment of the panel member to the fold-out shelf, the clamping assembly comprising:

(1) a first arm positioned normal to the bottom of the panel and having a first and second end, the first end being rigidly attached to the bottom surface;

(2) a second arm parallel to the bottom of the panel and also having a first end and a second end, the first end of the second arm rigidly connected to the second end of the first arm thus forming a channel between the bottom surface and the second arm; and, (3) a locking means associated with the second end of the second arm for secure frictional capture of the fold-out shelf within the channel and against the bottom surface.

4. The detachable accessory tray as claimed in claim 3, wherein the panel member includes wrap-around portions extending from each end of the rectangular portion,

5. The tray as claimed in claim 3, further comprising a plurality of panel legs extending a distance from the bottom surface of the panel member and exceeding the distance below the bottom surface that the clamp extends, whereby the horizontal orientation of the panel member can be maintained when the panel member is removed from the fold-out shelf and placed on a horizontal surface.

6. An accessory tray for detachable attachment to a fold-out shelf of a stepladder, the stepladder having a pair of front legs with the fold-out shelf pivotally positioned therebetween, comprising:

a. a panel member adapted to laterally span at least a distance measured between the outer surfaces of the pair of front legs;

b. a lip extending upwardly from the periphery of the panel member, the lip having a first notch therein at a first side of the panel member and a pair of spaced apart notches therein at a second side of the panel member opposite the first side, the pair of notches aligned with the first notch and spaced apart a distance substantially equal to a length of the first notch, the notches being adapted to receive and secure a roller paint tray to the panel member;

c. a recess in the panel member adapted to receive the pair of front legs of the stepladder therein, the recess presenting first and second portions of the panel adapted for longitudinal extension beyond the stepladder legs and in the same plane as the panel, member; and d. a clamp means for detachable attachment of said panel member to the fold-out shelf of the stepladder with the pair of legs positioned in the recess, the clamping means fixedly attached to the bottom surface and forming a channel between the bottom surface and the clamping means, the channel adapted for secure frictional capture of the fold-out shelf against the bottom surface by the clamping means, whereby the panel member is supported by the fold-out shelf when the fold-out shelf is horizontally positioned.

7. The accessory tray as claimed in claim 6, further comprising a plurality of panel legs extending a distance from a bottom surface of the panel member and exceeding the distance below the bottom surface that the clamp extends, whereby the horizontal orientation of the panel member can be maintained when the panel member is removed from the fold-out shelf and placed on a horizontal surface.

8. In a folding stepladder with rear legs supporting a plurality of treads therebetween and with the rear legs connected at their top ends to a top step, the rear legs connected at their top ends to a top step, either pair of front legs or rear legs being pivotally connected at a pivot point proximate with and immediately below the top step, the folding stepladder also having a fold out shelf interposed between the front legs so that a planar surface of the fold out shelf is positioned between the front legs and parallel to the plane of the front legs when not in use and positioned horizontally and away from the front legs when in use, the folding stepladder being symmetrical about a vertical plane interposed between the front and rear legs, an improvement comprising:

a. a substantially rectangular panel member having a bottom surface, a top surface, and a periphery, the panel member being secured to and supported by the fold out shelf when the fold out shelf is horizontally positioned;

b. a recess in the panel member receiving the front legs of the stepladder therein with the panel member laterally extending further from the vertical plane than the front legs and also extending rearward in the direction of the rear legs;

c. a lip extending upwardly from the periphery of the top surface, the lip having a first notch therein at a first side of the top surface and a pair of spaced apart notches therein at a second side of the top surface opposite the first side, the notches adapted to secure a roller paint tray to the panel member; and d. a clamp for attachment of the panel member to the fold out shelf; the clamp comprising:

(1) a first arm positioned normal to the bottom of the panel and having a first and second end, the first end of the first arm being rigidly attached to the bottom surface;

(2) a second arm parallel to the bottom surface and having a first end and a second end, the first end of the second arm rigidly attached to the second end of the first arm and forming a channel between the bottom surface and the second arm; and (3) a frictional capture means associated with the second end of the second arm, the frictional capture means frictionally capturing the fold out shelf against the bottom surface of the panel when the fold out shelf is inserted into the channel.

9. The improvement as claimed in claim 8, further comprising a plurality of panel legs extending a distance from the bottom surface of the panel member and exceeding the distance below the bottom surface that the clamp extends, whereby the horizontal orientation of the panel member can be maintained when the panel member is removed from the fold-out shelf and placed on a horizontal surface.

10. In a folding stepladder with rear legs supporting a plurality of treads therebetween and with the rear legs connected at their top ends to a top step, the rear legs connected at their top ends to a top step, either pair of front legs or rear legs being pivotally connected at a pivot point proximate with and immediately below the top step, the folding stepladder also having a fold out shelf interposed between the front legs so that a planar surface of the fold out shelf is positioned between the front legs and parallel to the plane of the front legs when not in use and positioned horizontally and away from the front legs when in use, the folding stepladder being symmetrical about a vertical plane interposed between the front and rear legs, an improvement comprising:

a. a substantially rectangular panel member having a bottom surface, a top surface, and a perimeter, the panel member having a surface area larger than the surface area of the fold out shelf, the panel member being secured to and supported by the fold out shelf when the fold out shelf is horizontally positioned;

b. a recess in the panel member receiving the front legs of the stepladder therein, with the panel member laterally extending further from the vertical plane than the front legs and also extending rearward in the direction of the rear legs; and, c. a lip extending upwardly from the perimeter and having notches therein, with a pair of the notches being formed in the recess, the notches and lip adapted to receive and secure a roller paint tray to the panel member.

11. The improvement as claimed in claim 10, further comprising a recess in the panel member, the recess receiving the front legs of the stepladder therein, with the panel member laterally extending further from the vertical plane than the front legs and also extending rearward in the direction of the rear legs.

12. The improvement as claimed in claim 10, further comprising an extension of the panel member a distance greater than the distance of the front legs from the vertical plane as measured in a direction normal to the vertical plane, and for the extension, a further rearward extension in the direction of the rear legs.

13. The improvement as claimed in claim 10, further comprising a plurality of panel legs perpendicularly extending a distance from the panel member, whereby the horizontal orientation of the panel member is maintained when the panel member is removed from the fold out shelf and placed on a horizontal surface larger than the perimeter of the panel member.

14. The improvement as claimed in claim 10, wherein the notches further comprise a first notch in a first side of the lip and the pair of notches spaced apart in a second side of the lip opposite the first side.

15. The improvement as claimed in claim 14, wherein the pair of notches are aligned with the first notch and are spaced apart a distance substantially equal to a length of the first notch.

16. The improvement as claimed in claim 10, further comprising a clamp for attachment of the panel member to the fold out shelf, the clamp comprising:

a. a first arm positioned normal to the bottom of the panel and having a first and second end, the first end of the first arm being fixedly attached to the bottom surface;

b. a second arm parallel to the bottom surface of the panel member and having a first end and a second end, the first end of the second arm fixedly attached to the second end of the first arm and forming a channel between the bottom surface and the second arm; and c. a frictional capture means associated with the second end of the second arm, the frictional capture means frictionally capturing the pivotal shelf against the bottom surface of the panel when the pivotal shelf is inserted into the channel.

17. The improvement as claimed in claim 16, further comprising a plurality of panel legs extending a distance from the bottom surface of the panel member and exceeding the distance below the bottom surface that the clamp extends, whereby the horizontal orientation of the panel member can be maintained when the panel member is removed from the pivotal shelf and placed on a horizontal surface.

18. The improvement as claimed in claim 16, further comprising a plurality of panel legs extending a distance from the bottom surface of the panel member and exceeding the distance below the bottom surface that the clamp extends, whereby the horizontal orientation of the panel member can be maintained when the panel member is removed from the pivotal shelf and placed on a horizontal surface.

19. The improvement as claimed in claim 10, further comprising a plurality of panel legs extending a distance from the bottom surface of the rectangular panel and exceeding the distance below the bottom surface that the clamp extends, whereby the horizontal orientation of the rectangular panel can be maintained when the rectangular panel is removed from the fold-out shelf and placed on a horizontal surface.

* * * * *